United States Patent [19]

McLaughlin

[11] Patent Number: 4,719,901

[45] Date of Patent: Jan. 19, 1988

[54] FLUE PIPE INSTALLATION THROUGH FLAMMABLE WALLS

[76] Inventor: Stephen D. McLaughlin, R.F.D. 1, Box 101, Lincolnville, Me. 04849

[21] Appl. No.: 6,499

[22] Filed: Jan. 23, 1987

[51] Int. Cl.[4] ..... F23J 13/00

[52] U.S. Cl. ..... 126/314; 126/316

[58] Field of Search ..... 126/314–319, 126/312, 307 R, 80; 98/46, 60, 58; 52/219

[56] References Cited

U.S. PATENT DOCUMENTS

| | | | |
|---|---|---|---|
| 364,651 | 6/1887 | Hutchins et al. | 126/314 |
| 450,355 | 4/1891 | Green | 126/314 |
| 563,587 | 7/1896 | Green | 126/314 |
| 677,447 | 7/1901 | Ethier | 126/314 |
| 1,321,675 | 11/1919 | Shurtleff | 126/314 |
| 1,584,912 | 5/1926 | Williamson | 126/314 |
| 1,744,269 | 1/1930 | Johnson | 126/314 |
| 4,463,748 | 8/1984 | Sinkes | 126/314 |

*Primary Examiner*—James C. Yeung

[57] ABSTRACT

There is provided a non-flammable pass-through unit for installation in new construction or as a substitute for a removed section of existing flammable wall in a building for the purpose of allowing the safe installation of a heating appliance, such as a wood or coal stove, and which will reduce the required clearances from a heating appliance to the wall in registry with a flue opening in an existing chimney located behind the wall. The unit comprises a frame composed of non-flammable vertical and horizontal galvanized sheet metal mambers. The metal frame defines an opening which, when the frame is installed, is centered on the axis of the chimney flue opening. A heat resistant, non-flammable tunnel is fitted into the opening and is butted against the chimney. A non-flammable sheathing covers the face of the metal frame, the sheathing defining an opening centered on the common axis for receiving a thimble and a stove pipe and adapted, when installed, to have its surface flush and merging with the surface of the flammable wall.

7 Claims, 5 Drawing Figures

FLUE PIPE INSTALLATION THROUGH FLAMMABLE WALLS

My invention is concerned with flue pipe installations especially adapted for passing through flammable walls and which will reduce the manufacturer's required clearances from a heating appliance to a wall.

BACKGROUND OF THE INVENTION

Typically, when a heating appliance, such as a wood stove, is to be installed in an existing room adjacent a flammable wall behind which is located the chimney, the stove must be spaced a required distance from the flammable wall and the stove pipe or thimble must pass through an opening in the wall which is both large enough to provide ample clearance and which is lined with insulation to shield the wall from the heat. Various systems have been proposed both for improving the protective assembly passing through the wall and for shielding the wall from the stove itself to reduce the required clearance.

Examples of such systems are to be found in U.S. Pat. Nos. 677,447; 794,301; 1,584,912; 3,046,976; 3,848,897; 4,463,748 and U.S. Pat. No. 4,543,942, dealing with stove pipe or thimble installations, and U.S. Pat. No. 4,399,805 which discloses a protective panel for insulating a wall from a nearby stove.

The present invention provides a wholly new approach to the solution of the problem sought to be solved by the prior art.

SUMMARY OF THE INVENTION

In accordance with the invention, there is provided a non-flammable pass-through unit for installation in new construction or as a substitute for a removed section of existing flammable wall in a building for the purpose of allowing the safe installation of a heating appliance, such as a wood or coal stove, and for the purpose of reducing the required clearances from a heating appliance to the wall in registry with a flue opening in an existing chimney located behind the wall. The novel unit comprises a frame composed of non-flammable vertical and horizontal members and is adapted to be fitted into a framed opening as in new construction or to be substituted for a corresponding wood framed portion of an existing wall of a building. The metal frame defines an opening which, when the frame is installed, is centered on the axis of the chimney flue opening. A heat resistant, non-flammable tunnel is fitted into said opening and is butted against the chimney centered on the aforesaid axis of its flue opening. A non-flammable sheathing covers the face of the metal frame, the sheathing defining an opening centered on the same common axis for receiving a thimble and a stove pipe and adapted, when installed, to have its surface flush and merging with the surface of the flammable wall.

In preferred embodiments, the unit is combined with adjacent portions of a flammable wall to provide a non-flammable pass-through unit mounted in an opening framed or cut in the wall, the metal frame defines a square opening and the tunnel is lined with non-flammable, heat resistant matting; the metal frame is composed of vertical metal studs and horizontal channel members and is adapted to a framed opening as in new construction or to be substituted for a corresponding wood framed portion of an existing wall; a stove pipe section is mounted in the tunnel with one end protruding through the opening in the sheathing and the other extended through the flue opening into the chimney; the opening framed or cut in the flammable wall extends from floor to ceiling, but is in no event less than 48"×48"; and the matting in said tunnel is made of ceramic material.

Still further objects, features and advantages of the invention will become clear from the following detailed description of a presently preferred embodiment thereof taken in conjunction with the accompanying drawings.

DETAILED DESCRIPTION OF PREFERRED EMBODIMENT

Figure 1:
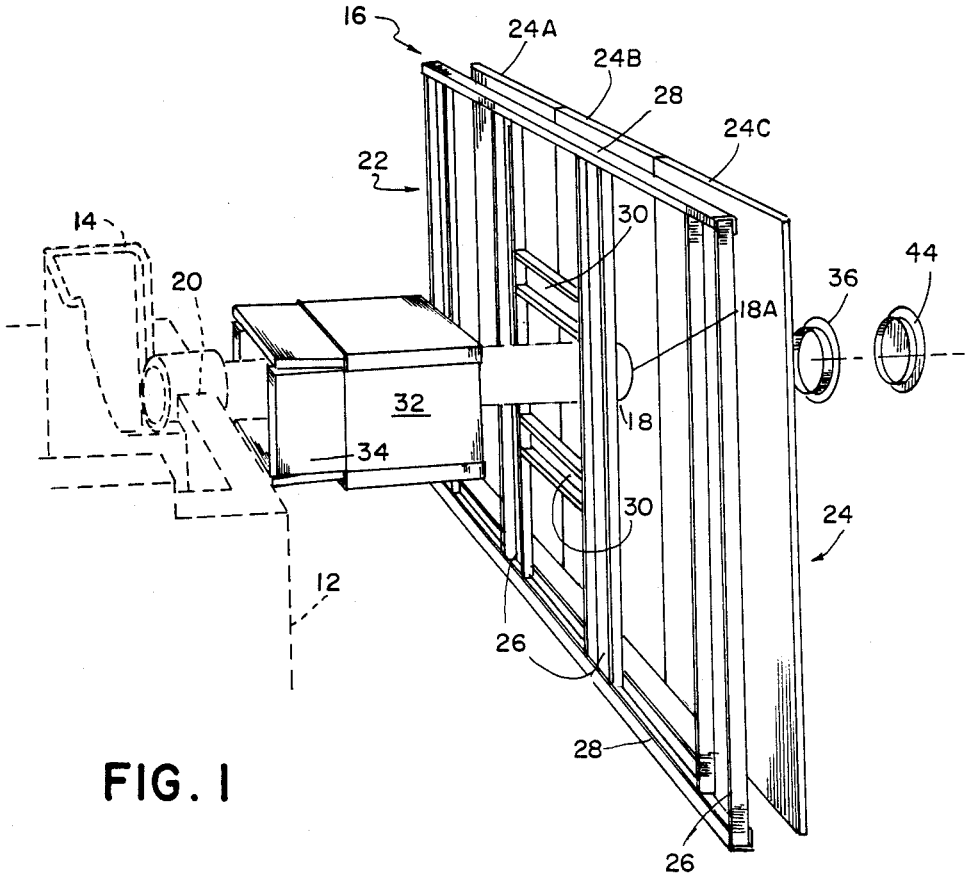
FIG. 1 comprises an exploded view in perspective of the parts of a system according to the invention as applied to an installation for running the smoke pipe from a stove (not shown) through a flammable wall (also not shown) and into the flue of an existing chimney located behind the wall.

A flammable wall 10 (FIG. 4) in front of a chimney 12 (FIGS. 2 and 3) having a flue 14, has been cut out or framed to provide an opening 15 (FIG. 4) of size to accommodate the assembled components of the novel system. This should be an opening that may extend from floor to ceiling in cases where a heating appliance is to be placed close to the wall. This enables a stove to be placed closer to the wall than permitted by the code when the wall is flammable. The opening may also extend a substantial distance to either side of the thimble location. In all cases it should be not less than 48"×48" with the stove pipe at the exact center.

The rough opening 15 is framed by studs 17, 19 (FIG. 4) with the framing no closer than two inches (dimension A, FIG. 3) from the chimney masonry. The framed opening is sized to fit the wall unit 16 (FIG. 1) which is provided with a tunnel 32 received by opening 18 (FIGS. 1, 2, 3) centered on the opening 20 to the flue in the chimney.

Referring to FIG. 1, the wall unit 16 comprises a metal frame portion 22 which, when installed, lies in the plane of the studs 17, 19 of the existing wall or framed opening, and a surface section 24 of non-flammable sheet material which becomes flush with and forms a continuation of the existing wall. In the embodiment shown, the portion 22 comprises vertical galvanized sheet metal studs 26 held between horizontal metal holding channels 28 also of galvanized sheet metal. The tunnel passage 18 is formed by mounting a pair of metal cross supports 30 between the central pair of studs 26 at the required height to define a square opening centered on the flue opening of the chimney.

Figure 2:
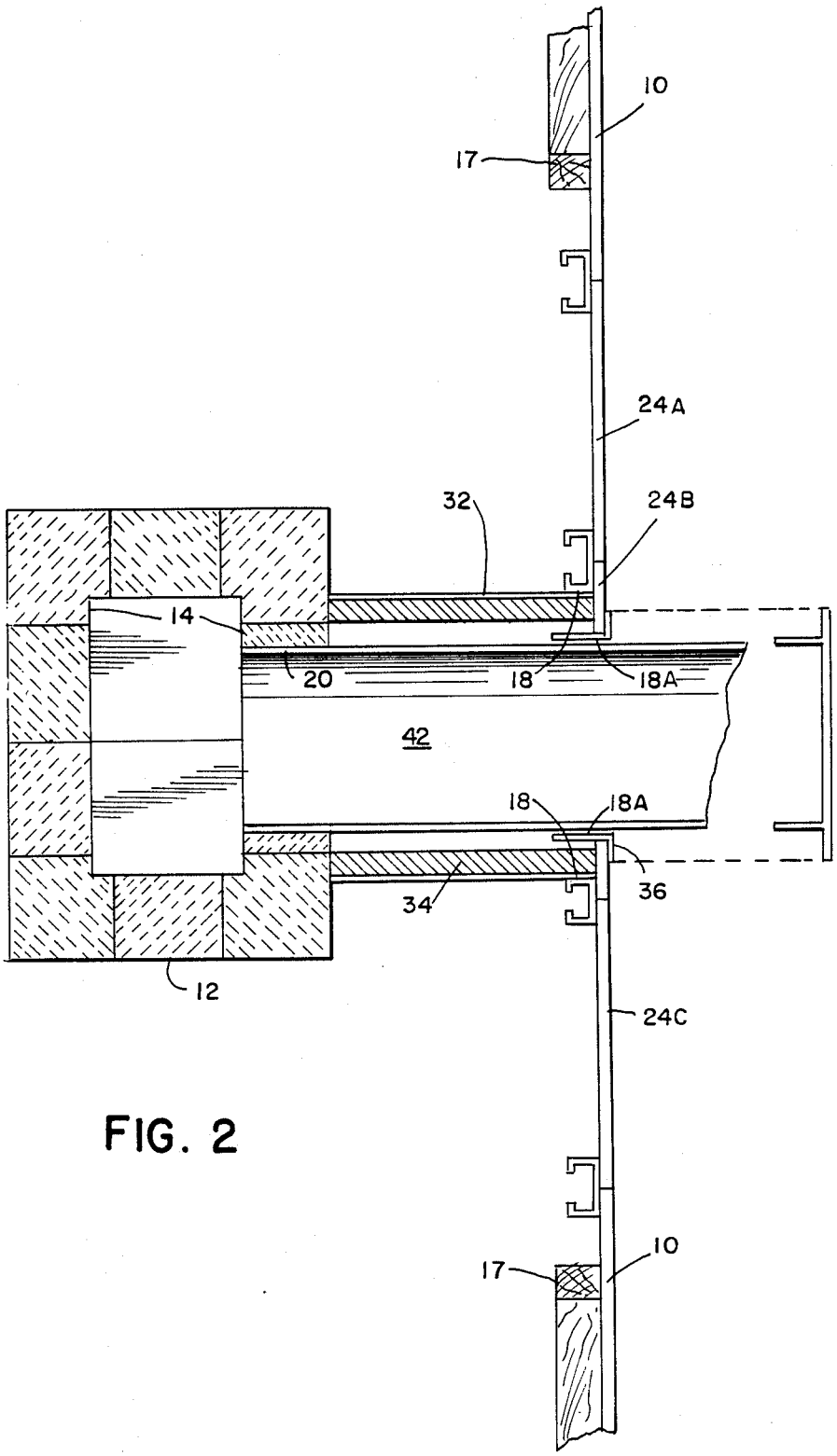
FIG. 2 is a horizontal section of the system shown in FIG. 1 as installed in the wall and in communication with the chimney flue.
Figure 3:
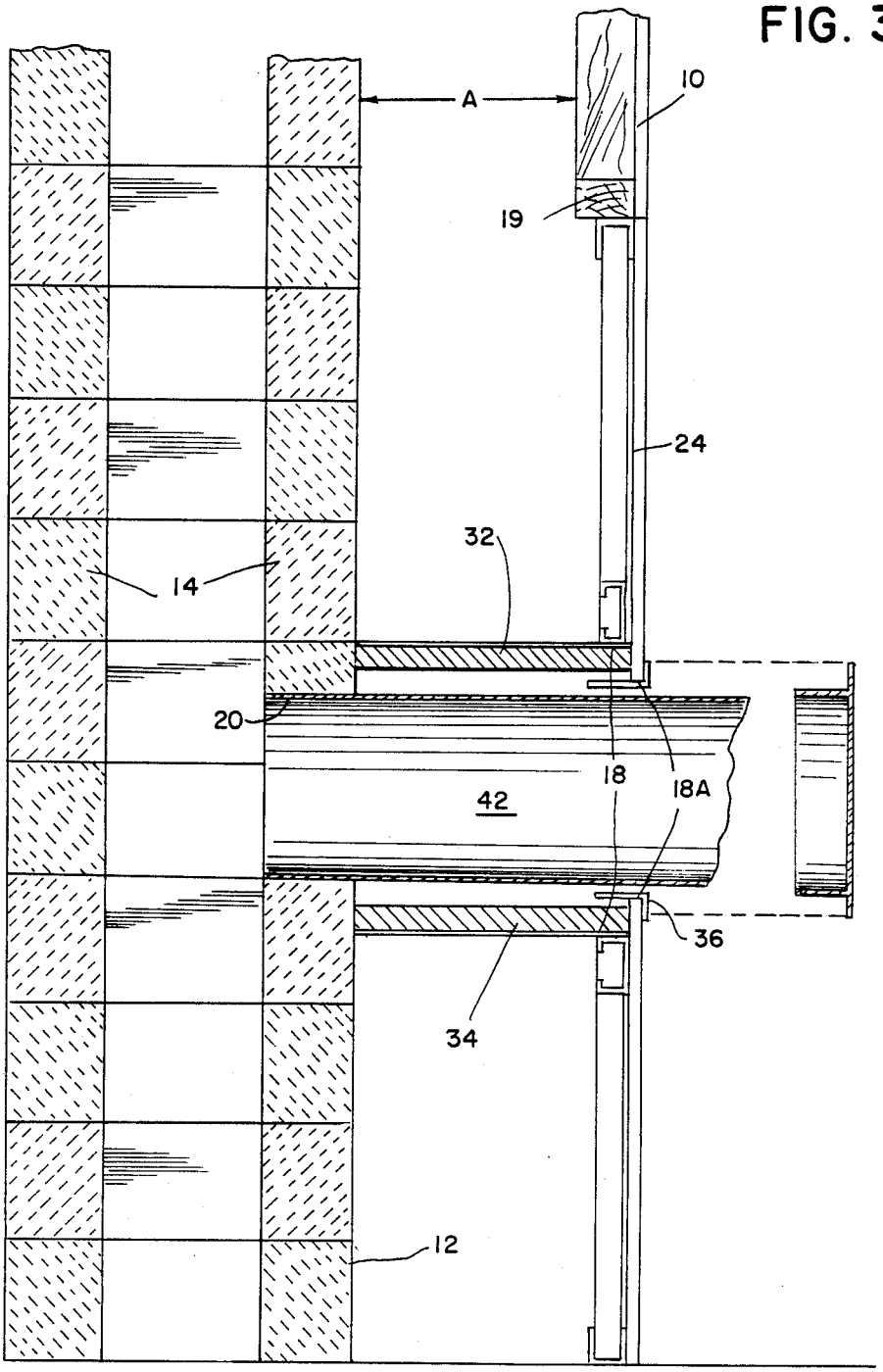
FIG. 3 is a vertical section of the same.
Figure 4:
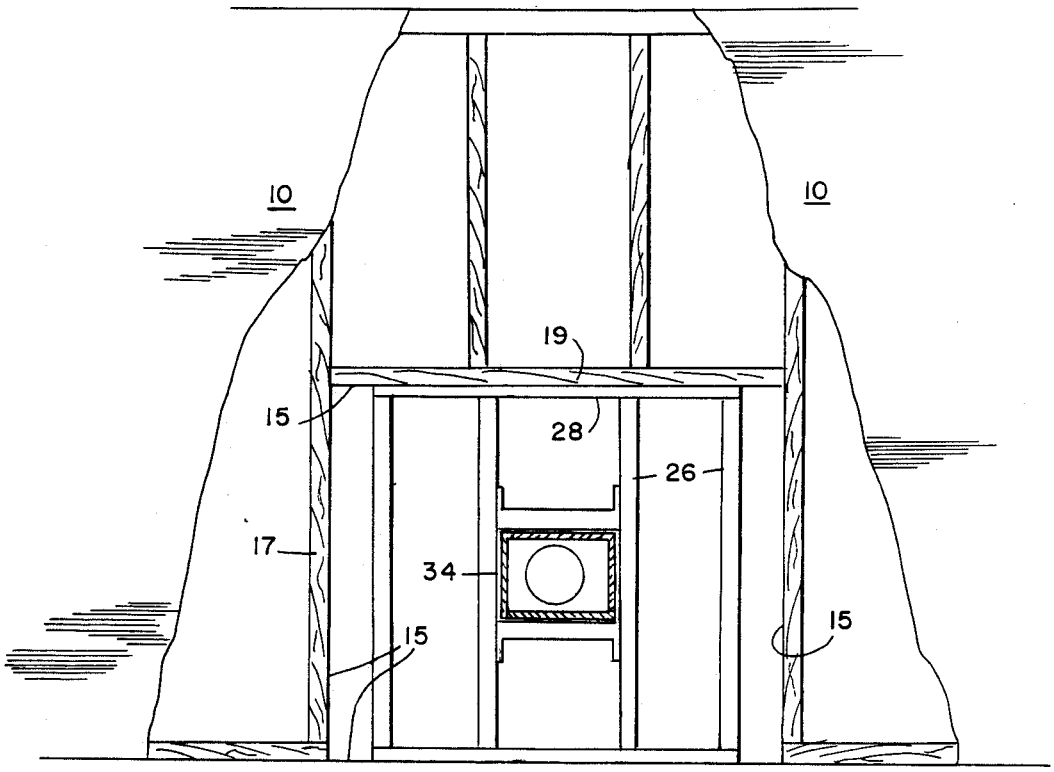
FIG. 4 is a front elevation of the system as framed in but before the surface sheet sections have been applied as viewed from the room side.
Figure 5:
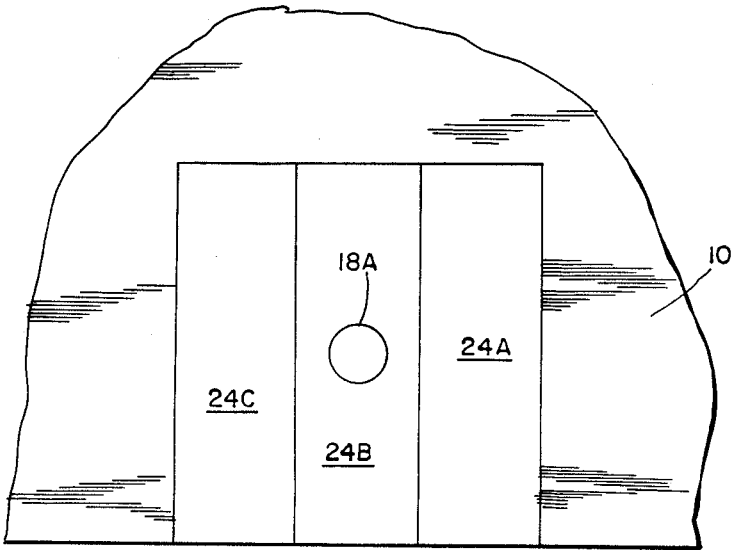
FIG. 5 is an elevation of the completely installed system as viewed from the room side showing how it blends into and becomes part of the wall.

The tunnel 32 having a square cross-section is formed by assembling together four sheet metal rectangles as shown. The tunnel is mounted in the opening 18 by any suitable means so that its outer end is flush with the room side of the vertical studs 26 and cross supports 30 and its inner end is touching the chimney. The tunnel is then lined with non-combustible insulation 34, preferably comprised of one inch thick ceramic fiber matting, which has a squeeze fit with the chimney and is flush at the other end with the tunnel mouth. A ceramic fiber mat produced by Eastern Refractory Company, Inc., and sold under the trademark ERCO MAT is entirely suitable for this purpose. Any equivalent material may be used. The unit is now ready to receive the surface section 24 (FIG. 1) and thimble 36 (FIGS. 1, 2, 3).

The surface section 24 comprises side by side rectangular sheets 24A, 24B and 24C of a suitable non-combustible material. I have found that calcium silicate panels manufactured by Johns Manville Co., Inc., under the trademark MARINITE I or the equivalent is a suitable material from which the surface sections can be formed. This material has the appearance of sheet rock and will blend perfectly into and appear to be merely a part of an existing plaster or dry wall. A suitable number of sheets are used depending on the size of the unit but no less than a section of 48"×48" with the flu opening as its exact center.

The central surface section 24B is provided with a cut-out opening 18A which will be exactly opposite the center of the tunnel 32 when installed. The thimble 36 is mounted in this opening suitably sealed with silicone sealant about its junction with the section 24B on the back side of the latter or fixed by any other suitable means. The section 24B is then positioned against the frame defined by the vertical studs 26 and channel members 28 with the exact center of the thimble centered in the tunnel and, preferably, temporarily held in place by a pair of sheet rock screws. A short section 42 (FIGS. 2, 3) of stove pipe is now inserted through the thimble 36 and tunnel and through the opening 20 of the chimney 12. It will extend outward at a right angle to the chimney and its entire circumference should be spaced one-half inch from the inner surface of the wall thimble 36.

Now, attachment of the surface section 24B to the frame is completed and the remaining surface sections 24A and 24C installed. Their joints will be centered on the studs if the studs were correctly placed. The installation is completed by matching sheet rock to the sides of the non-combustible sheets and finishing the surfaces to match. Cap 44 may close the open end of the thimble 36 unless and until connection is made to a stove.

It will be seen that by replacing a given section of a flammable wall with the novel non-flammable unit or by introducing this unit to a framed opening as in new construction, the problems associated with the installation of heating appliances such as wood or coal stoves are greatly reduced. The final installation is attractive and meets all requirements for fire safety.

While I have herein disclosed and described a presently preferred embodiment of the invention, it will nevertheless be understood that the same is intended to be by way of example only and that the scope of the invention is defined by the proper interpretation to be accorded the appended claims.

I claim:

1. In combination with a flammable wall in a building a non-flammable pass-through unit mounted in a framed opening in said wall as a substitute wall section for the purpose of allowing the safe installation of a heating appliance, such as a wood or coal stove, in registry with a flue opening in an existing chimney located behind the wall comprising a metal frame composed of vertical metal studs and horizontal channel members, said metal frame adapted to fit an opening framed in a new flammable wall or cut and framed in an existing flammable wall as a substitute for a corresponding wood framed section of an existing wall of a building, said metal frame defining a square opening which, when the frame is installed, is centered on the axis of the chimney flue opening, a tunnel lined with non-flammable, heat resistant matting fitted into said opening and butting against said chimney and centered on said axis, and non-flammable sheathing covering the face of said frame, said sheathing defining an opening centered on said axis for receiving a thimble and a stove pipe and adapted, when installed, to have its surface flush and merging with the surface of the flammable wall.

2. The combination as claimed in claim 1 wherein said opening cut in said wall extends from floor to ceiling.

3. The combination as claimed in claim 1 wherein said opening cut in said wall is not less than 48"×48".

4. The unit as claimed in claim 1 wherein said tunnel is square in cross-section to fit said square opening.

5. The unit as claimed in claim 4 including a stove pipe section mounted in said tunnel with one end protruding through the opening in said sheathing and the other extending through said flue opening.

6. A method of providing a non-flammable pass-through unit for use in new wall construction or, in the case of retro-fitting, as a substitute for a removed section of an existing flammable wall of a building, for the purpose of allowing the safe installation of a heating appliance, such as a wood or coal stove, and for the purpose of reducing required clearance from the appliance to the wall, which comprises providing a framed opening in said wall opposite a flue opening in an existing chimney located behind the wall, assembling a frame of non-flammable vertical metal studs and horizontal metal channel members to define a square opening, said non-flammable frame adapted to fit said framed opening as a substitute for the missing section of flammable wall, the square opening of said non-flammable frame when the frame is installed being centered on the axis of the chimney flue opening, mounting in said last named opening a heat resistant, non-flammable square tunnel fitted therein and butting against said chimney and centered on said axis, and covering the face of said non-flammable frame with non-flammable sheathing, said sheathing defining an opening centered on said axis for receiving a thimble and a stove pipe and adapted, when installed, to have its surface flush and merging with the surface of the flammable wall.

7. The method as claimed in claim 6 including the step of mounting a stove pipe section in said tunnel with one end protruding through the opening in said sheathing and the other extending through said flue opening.

* * * * *